US006492969B1

(12) United States Patent
Budzelaar

(10) Patent No.: US 6,492,969 B1
(45) Date of Patent: Dec. 10, 2002

(54) COMBINING TWO SUCCESSIVE COLORS GETS COLORS PURE

(75) Inventor: Franciscus Paulus Maria Budzelaar, Eindhoven (NL)

(73) Assignee: Koninklijke Philips Electronics N. V., Eindhoven (NL)

( * ) Notice: Subject to any disclaimer, the term of this patent is extended or adjusted under 35 U.S.C. 154(b) by 290 days.

(21) Appl. No.: 09/587,399

(22) Filed: Jun. 5, 2000

(30) Foreign Application Priority Data

Jun. 10, 1999 (EP) ..... 99201843

(51) Int. Cl.[7] ..... G09G 3/36; G09G 5/10

(52) U.S. Cl. ..... 345/88; 345/87; 345/98; 345/690

(58) Field of Search ..... 345/88, 589, 593, 345/597, 601, 87, 90, 98, 690

(56) References Cited

U.S. PATENT DOCUMENTS 5,170,152 A * 12/1992 Taylor ..... 340/703
6,160,535 A * 12/2000 Park ..... 345/153
6,177,914 B1 * 1/2001 Iwama et al. ..... 345/60
6,259,425 B1 * 7/2001 Shimizu ..... 345/94

FOREIGN PATENT DOCUMENTS

WO 9409475 A1 4/1994 ..... G09G/3/36

* cited by examiner

*Primary Examiner*—Steven Saras
*Assistant Examiner*—Michael J Moyer

(57) ABSTRACT

A color-sequential LCD image display apparatus is operated through controlling an array of pixelized display elements for in each element rendering a plurality of colors in sequence. In particular, a compensating operation is executed against color impurities for a later color due to a non-instantaneous response of such elements as a result of an immediately preceding color for the element in question, under control of the combined color signals associated with both said immediately preceding color and said later color.

5 Claims, 1 Drawing Sheet

COMBINING TWO SUCCESSIVE COLORS GETS COLORS PURE

A method and apparatus for generating a color-sequential LCD image display through controlling pixelized display elements for rendering a plurality of colors in sequence, whilst combining control signals for two successive colors against impurities from non-instantaneous response.

BACKGROUND OF THE INVENTION

The invention relates to a color sequential display apparatus. Color sequential imaging systems generally use a single element to create red, blue, green and possibly white images sequentially in time for a particular pixel, although other color combinations have been used as well. If this image element, or the controlling mechanism in general has relaxation effects, the various color images may influence each other. In principle, an electronic pre-correction system may mitigate such effects, but this would require either introducing an additional image memory, or rather a higher bandwidth.

SUMMARY TO THE INVENTION

In consequence, amongst other things, it is an object of the present invention to effect such compensation at least in part, without needing additional expensive hardware. The inventor has recognized that in principle, the various colors are provided in parallel at a certain stage of the image generating.

Now therefore, according to one of its aspects the invention is characterized by executing a compensating operation against color impurities for a later color due to a non-instantaneous response of a display element as a result of an immediately preceding color for the element, under control of the combined color signals associated with both the immediately preceding color and the later color. Generally, color sequential systems have lower system costs compared to systems wherein for each separate color a particular pixel would need a specific image element to be used in parallel for creating a color image. However, the most popular element in use today, to wit LCD, is relatively slow in reacting to control signals applied thereto. In a color-sequential application, such relaxation means that information displayed in a first color may "bleed" into another next-following color for the same pixel. If, for example, the sequence is read-green-blue-red-etcetera, information contained in the green image may be influenced by the immediately preceding red image. The effect can be mitigated by electrically pre-correcting the signal fed to the image element. However, to do this, the pre-correction system must access the immediately preceding multicolor image. Converting a standard RGB image into a color sequential signal requires an image memory. Subsequent accessing of this information for color correction would then necessitate to double the bandwidth of the image memory, with associated cost increase. In contradistinction, according to the present invention the pre-correction is executed at an instant before converting from RGB to a color-sequential signal. At such earlier instant, the various color control signals would be available simultaneously. The optimum solution for an RGB sequence has the pre-correction of the green based on the red signal, and the pre-correction of the blue signal based on the red signal. Basing the pre-correction of the red signal on the blue signal from the previous frame would again require an image memory for one color, because this blue color image was then the most recent image sent to the image element.

If also applying the correction mechanism to the first color control signal for the current image, the usage of an additional image memory is obviated by not using the blue signal of the previous frame, but rather the blue signal of the current frame or image. For static images, the correction mechanism will now be perfect. For non-stationary images however, some motion-induced color artefacts may occur. These small effects would introduce some bleeding of one color into another color. The worst case occurs when a saturated blue object moves over an almost black area. The pre-correction will now give a result that is slightly mislocated. Certain user tests have however found that the resultant effect is generally overlooked, inter alia, because the human eye/brain combination tends to be less sensitive for many temporal changes.

The invention also relates to an apparatus being arranged for practicing a method characterized by executing a compensating operation against color impurities for a later color due to a non-instantaneous response of a display element as a result of an immediately preceding color for the element, under control of the combined color signals associated with both the immediately preceding color and the later color.

BRIEF DESCRIPTION OF THE DRAWING

These and further aspects and advantages of the invention will be discussed more in detail hereinafter with reference to the disclosure of preferred embodiments, and in particular with reference to the appended Figures that show.

DETAILED DESCRIPTION OF PREFERRED EMBODIMENTS

Figure 1:
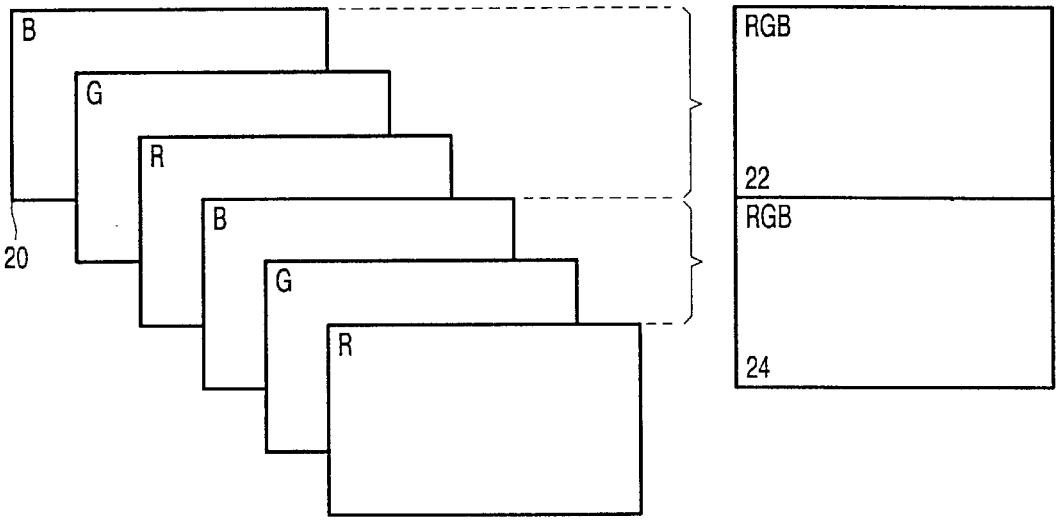
FIG. 1, a sequence of single-color frames for producing a full-color frame.

FIG. 1 shows a sequence of single-color frames for producing a full-color frame. At left, an exemplary sequence 20 of blue-green-red-blue-green-red single-color frames are shown, of which each time three blue-green-red frames combine to a respective multi-color RGB frame 22, 24. An additional white frame may be used for raising the brightness of the picture, sometimes at a cost of having a somewhat narrower color palette. The sequence of the one-color frames may be different, but is generally uniform in time. The physical nature of the rendering of colors on the display elements is standard in the art, and will not be further discussed.

Figure 2:
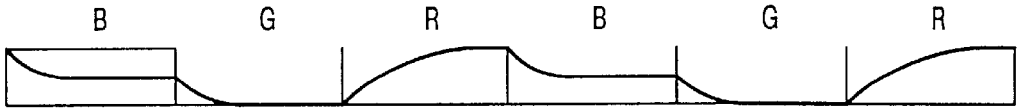
FIG. 2, time-sequential organization of various color signals.
Figure 3:
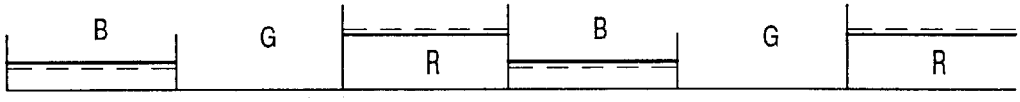
FIG. 3, the nature of executing color compensation.

FIG. 2 shows a time sequential organization of various color signals. Although not to be considered as a restriction, in the Figure each signal has a uniform duration, as indicated by the associated BGR indications. Generally, lengthening the duration of a color period will raise the intensity of that color. Now, FIG. 3 shows the nature of executing color compensation. By way of example, the intended intensities of the respective colors have been shown as drawn lines, and for explanatory purpose, the control signal amplitude is supposed to be generally proportional to the associated color intensity. FIG. 2 shows the effect of the relaxation, that in fact represents a kind of low-pass filter, the initial part of the color signal being displaced in the direction of the immediately preceding amplitude. Both the time constant and the intensity of the relaxation effect depend on the actual display element technology, and on the size and direction of the step between successive control signals. FIG. 3, therefore, also shows applicable control signal amendments, as being represented in interrupted lines: the blue signal is attenuated somewhat, and the red signal is amplified somewhat. It is noted that a negative control signal, which would be necessary for the green signal, is impossible in practice; however, the inaccuracy caused by this restriction is generally quite small. Note that FIGS. 2, 3 represent only an example for a particular color mix.

Now, the red signal amendation is controlled by the immediately preceding green signal, so that the eventual control signal is governed by the combined control signals for two directly successive colors. Likewise, the green signal amendation is controlled by the immediately preceding blue signal. The size of the necessary control signals has not been considered herein any further, inasmuch as it would be fully determined by the particular technology of the display apparatus. Now however, amending the blue signal through the immediately preceding red signal would imply taking recourse to the red signal (the last one) of the preceding image, and the providing thereof for effectively amending would either necessitate an image buffer, or rather necessitate raising the actually used bandwidth, because two accesses would be necessary. By way of simplification and cost reduction, the present invention allows therefore to take the succeeding red signal of the same image as reference. For stationary or slow-moving images, the difference between the two approaches is well-nigh invisible. Only for fast-moving images, or upon camera jumps and the like, a brief disturbance would exist. Due to the perceptual nature of the human eye, the visibility of such disturbance is generally slight.

Figure 4:
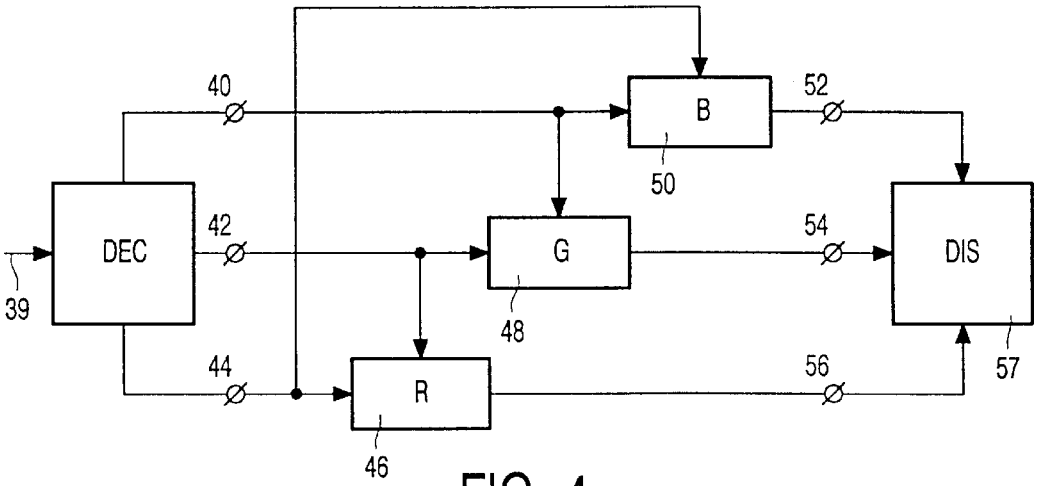
FIG. 4, a hardware set-up for executing such compensation.

FIG. 4 shows a hardware set-up for executing the compensation according to the present invention. Inputs 40, 42, 44 receive the respective blue, green and red signals in parrallel with each other, as they have been derived in parallel from the compound color signal received. For simplicity, such color decoder DEC has been represented by a single block to receive a compound color signal on input 39. Now, the blue signal is coupled into amending element 48 for amending the green signal that in the sequential organization of FIGS. 2, 3 comes later. The green signal is coupled into amending element 46 for amending the red signal that in the sequential organization of FIGS. 2, 3 comes later. Finally, the red signal is coupled into amending element 50 for amending the blue signal that in the sequential organization of FIGS. 2, 3 comes earlier in the instant frame organization. The amount of amending may controlled by any of various mechanisms that have been in use for generating color control signals, such as a color-look-up table CLUT, a calculating mechanism based on an expression, or other. For brevity, the respective electronic realizations of the attenuating, calculating and amplifying operations in blocks 46, 48, 50 have been suppressed as being straightforward developments for a person skilled in the art. The outputs 52–56 are coupled to the actual mechanism 57 for effecting the pixel-organized coloring. This mechanism may contain an image memory, that needs reading only in synchronism with the sequential displaying of the pixel colors, but no faster. For brevity, no further details have been shown in the Figure.

What is claimed is:

1. A method for operating a color-sequential LCD image display apparatus through controlling an array of pixelized display elements for at each element rendering a plurality of colors in sequence, said method being characterized by executing a compensating operation against color impurities for a later color due to a non-instantaneous response of such elements as a result of an immediately preceding color for the element in question, under control of the combined color signals associated with both said immediately preceding color and said later color.

2. A display apparatus for generating a color-sequential LCD image through an array of pixelized display elements, each element being arranged for rendering a plurality of colors in sequence, characterized by having compensating means (46, 48) for executing a compensating operation against color impurities for a later color due to a non-instantaneous response of such elements as a result of an immediately preceding color for the element in question, through developing a secondary control signal (54, 56) from the combined primary color signals (42, 44) associated with both said immediately preceding color and said later color.

3. An apparatus as claimed in claim 2, wherein said compensating means (50) is operative for a first color within a frame as based on another succeeding color signal (44) in the same frame.

4. An apparatus as claimed in claim 2, wherein such display element (57) is operative for displaying all colors pertaining to an associated pixel element.

5. A color display device, comprising:

a plurality of pixelized display elements each adapted to sequentially display a plurality of colors; and a compensation device adapted to receive a first signal corresponding to a first color displayed by one of the display elements, and adapted to receive a second signal corresponding to a second color to be displayed by the one display element immediately subsequent to displaying the first color, the compensation circuit outputting a compensated signal for displaying the second color by the one display element, the compensated signal compensating for a non-instantaneous response of the one display element in switching between displaying the first and second colors.

* * * * *